US010161690B2

(12) United States Patent
Zaffetti et al.

(10) Patent No.: US 10,161,690 B2
(45) Date of Patent: Dec. 25, 2018

(54) MULTI-LAYER HEAT EXCHANGER AND METHOD OF DISTRIBUTING FLOW WITHIN A FLUID LAYER OF A MULTI-LAYER HEAT EXCHANGER

(71) Applicant: Hamilton Sundstrand Space Systems International, Inc., Windsor Locks, CT (US)

(72) Inventors: Mark A. Zaffetti, Suffield, CT (US); Jeremy M. Strange, Windsor, CT (US); Dale T. Cooke, Suffield, CT (US)

(73) Assignee: HAMILTON SUNDSTRAND SPACE SYSTEMS INTERNATIONAL, INC., Windsor Locks, CT (US)

( * ) Notice: Subject to any disclaimer, the term of this patent is extended or adjusted under 35 U.S.C. 154(b) by 797 days.

(21) Appl. No.: 14/492,826

(22) Filed: Sep. 22, 2014

(65) Prior Publication Data

US 2016/0084580 A1 Mar. 24, 2016

(51) Int. Cl.
*F28F 3/06* (2006.01)
*F28D 9/00* (2006.01)

(52) U.S. Cl.
CPC ..... *F28F 3/06* (2013.01); *F28D 9/0068* (2013.01); *F28D 9/0093* (2013.01)

(58) Field of Classification Search
CPC .... F28F 3/027; F28F 3/025; F28F 3/06; F28F 3/08; F28F 3/083; F28D 9/0006; F28D 9/0025; F28D 9/0031; F28D 9/0037; F28D 9/0062; F28D 9/0043; F28D 9/005; F28D 9/0056; F28D 9/0075; F28D 1/0308
USPC ..... 165/164–171, 179, 183; 29/890.039
See application file for complete search history.

(56) References Cited

U.S. PATENT DOCUMENTS 3,359,616 A * 12/1967 Butt ..... B21D 53/04 165/166
5,009,263 A * 4/1991 Seshimo ..... F28D 15/02 165/151
2008/0202731 A1* 8/2008 Brunner ..... F28F 13/12 165/109.1
2009/0314480 A1* 12/2009 Grinbergs ..... F24F 3/1411 165/174
2010/0263823 A1* 10/2010 Mitsuhashi ..... F28D 9/0062 165/11.1

(Continued)

FOREIGN PATENT DOCUMENTS

EP 2672798 A2 * 12/2013 ..... H05K 7/20254
GB 1411122 A * 10/1975 ..... F25J 5/002

(Continued)

*Primary Examiner* — Travis Ruby
(74) *Attorney, Agent, or Firm* — Cantor Colburn LLP

(57) ABSTRACT

A multi-layer heat exchanger includes a fluid layer defined by a first sheet and a second sheet, the fluid layer configured to route a fluid in a predominant flow direction. Also included is a fluid inlet port disposed proximate an inlet end region of the fluid layer, wherein the fluid inlet port is oriented to introduce the fluid into the fluid layer in a direction substantially perpendicular to the predominant flow direction, wherein the inlet end region of the fluid layer comprises a non-linear geometry. Further included is at least one fin segment disposed between the first sheet and the second sheet, wherein the at least one fin segment includes a first plurality of apertures proximate the inlet end region.

2 Claims, 5 Drawing Sheets

(56) References Cited

U.S. PATENT DOCUMENTS

2012/0255288 A1* 10/2012 Berger ..... F28D 9/0068
60/320
2014/0150662 A1* 6/2014 Vandermeulen ..... F28F 1/02
96/295

FOREIGN PATENT DOCUMENTS

JP 09122481 A * 5/1997 ..... B01J 19/0013
WO WO 03044344 A1 * 5/2003 ..... F01N 3/043
WO WO 2011048574 A2 * 4/2011 ..... F24H 1/40

* cited by examiner

MULTI-LAYER HEAT EXCHANGER AND METHOD OF DISTRIBUTING FLOW WITHIN A FLUID LAYER OF A MULTI-LAYER HEAT EXCHANGER

FEDERAL RESEARCH STATEMENT

The subject matter of this disclosure was made with government support under Contract No. NNJ06TA25C awarded by National Aeronautics and Space Administration. The government therefore may have certain rights in the disclosed subject matter.

BACKGROUND OF THE INVENTION

The embodiments described herein generally relate to heat exchangers and, more particularly, to a multi-layer, multi-fluid heat exchanger, as well as a method of distributing flow within a fluid layer of such multi-layer heat exchangers.

In multi-layer and multi-fluid plate and fin heat exchangers, fluid ports are required to be located on the side of the heat exchanger. However, the fluid flow is perpendicular to the direction in which the fluid in introduced into the heat exchanger via the fluid port. In order to turn the flow to the correct direction, angled fin sections are used. In heat exchangers that have "tented" ends, multiple angled fin sections are required. Often, five or more separate fin sections are required per fluid layer. Such configurations result in increased part count, more complicated fabrication, and therefore increased overall cost.

BRIEF DESCRIPTION OF THE INVENTION

According to one embodiment, a multi-layer heat exchanger includes a fluid layer defined by a first sheet and a second sheet, the fluid layer configured to route a fluid in a predominant flow direction. Also included is a fluid inlet port disposed proximate an inlet end region of the fluid layer, wherein the fluid inlet port is oriented to introduce the fluid into the fluid layer in a direction substantially perpendicular to the predominant flow direction, wherein the inlet end region of the fluid layer comprises a non-linear geometry. Further included is at least one fin segment disposed between the first sheet and the second sheet, wherein the at least one fin segment includes a first plurality of apertures proximate the inlet end region.

According to another embodiment, a method of distributing flow within a fluid layer of a multi-layer heat exchanger is provided. The method includes introducing a fluid into the fluid layer through a fluid inlet port in a direction substantially perpendicular to a predominant flow direction of the fluid within the fluid layer, the fluid inlet port located proximate an inlet end region of the fluid layer. The method also includes redirecting the fluid proximate the inlet end region with at least one fin segment having a plurality of apertures defined by the at least one fin segment, the plurality of apertures located proximate the inlet end region.

BRIEF DESCRIPTION OF THE DRAWINGS

The subject matter which is regarded as the invention is particularly pointed out and distinctly claimed in the claims at the conclusion of the specification. The foregoing and other features and advantages of the invention are apparent from the following detailed description taken in conjunction with the accompanying drawings in which:

DETAILED DESCRIPTION OF THE INVENTION

Figure 1:
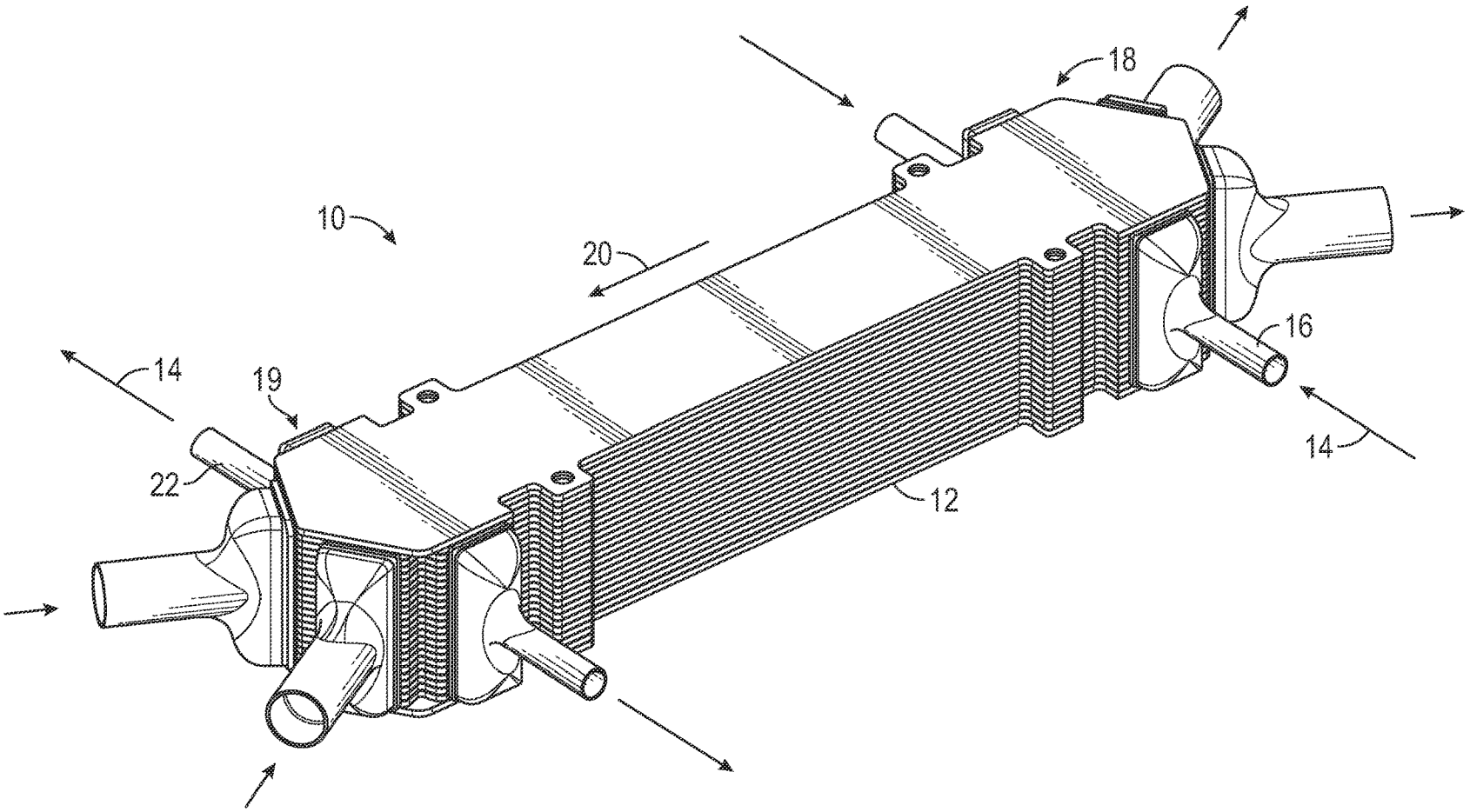
FIG. 1 is a perspective view of a heat exchanger.

Referring to FIG. 1, a heat exchanger is illustrated and generally referred to with numeral 10. The heat exchanger 10 is a multi-layer heat exchanger employed to allow heat transfer between multiple fluids being routed through various layers of the heat exchanger 10 and/or to exchange heat with one or more components disposed in contact with the heat exchanger 10. The heat exchanger 10 may be used in numerous contemplated applications, including aviation applications, for example.

As shown in the illustrated embodiment, the heat exchanger 10 includes a plurality of fluid layers 12 that are configured to route various fluids therein in a manner that isolates the fluids from each other. In the illustrated embodiment, a plurality of fluids are configured to be introduced into respective layers of the heat exchanger 10 via inlet ports and configured to be expelled from the heat exchanger via outlet ports. For example, a first fluid 14 is configured to be introduced to the heat exchanger via a fluid inlet port 16 that is located proximate an inlet end region 18 of the fluid layer in which it is to be introduced. The first fluid 14 is routed through the fluid layer of the heat exchanger 10 in a predominant flow direction 20 and expelled from the fluid layer via a fluid outlet port 22 located proximate an outlet end region 19 of the fluid layer. The inlet end region 18 and the outlet end region 19 are formed of geometries that have non-linear ends, such that angled geometries are required. A single fluid has been described above for simplicity of description, but as shown and as can be appreciated, additional fluids may be introduced into the heat exchanger via additional inlet ports and expelled via additional outlet ports.

The fluid inlet port 16 is oriented in a manner that introduces the first fluid 14 into the heat exchanger 10 in a direction that is substantially perpendicular to the predominant flow direction 20, such that immediate turning of the first fluid 14 is required to ensure optimal overall flow characteristics of the first fluid 14 in the fluid layer in spite of the non-linear end regions 18, 19.

Figure 2:
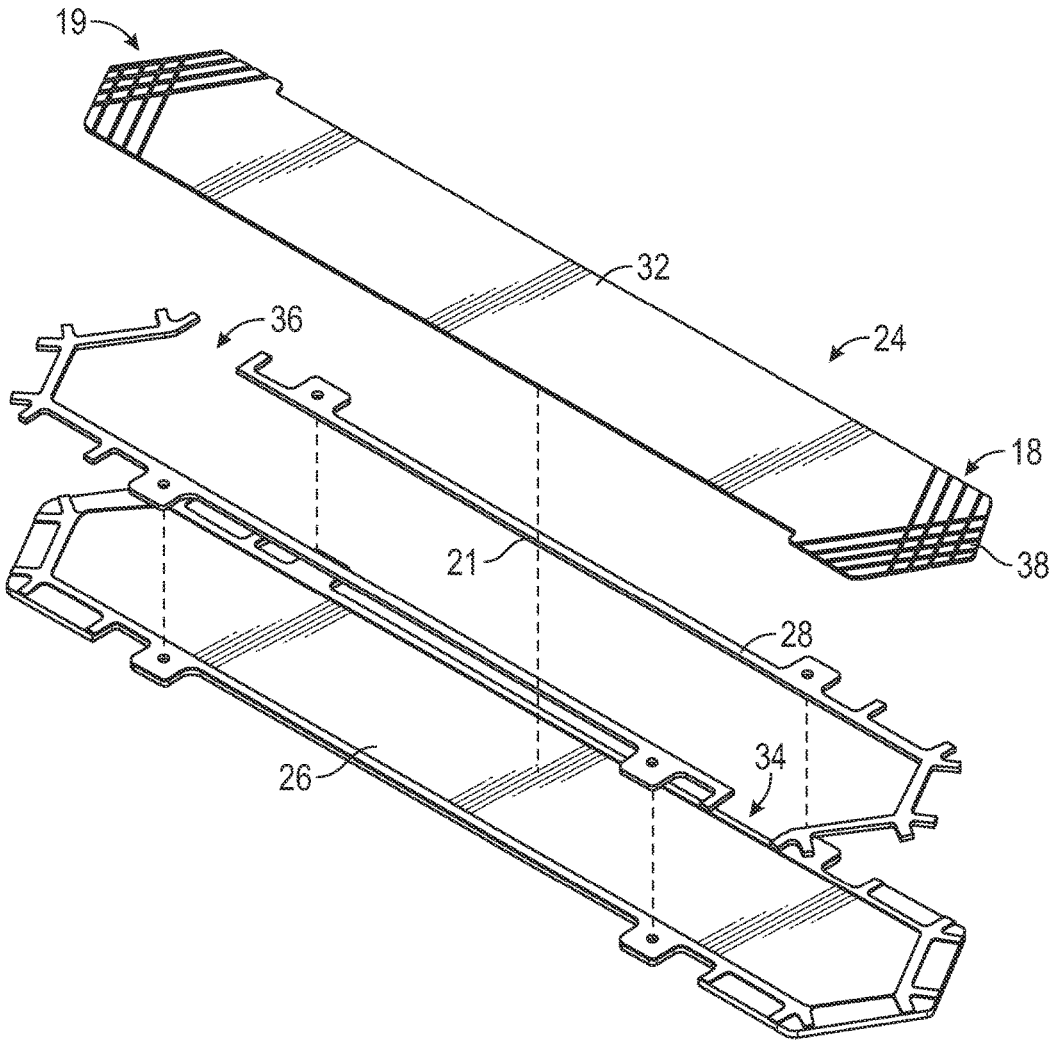
FIG. 2 is an exploded view of a layer of the heat exchanger according to a first embodiment.
Figure 3:
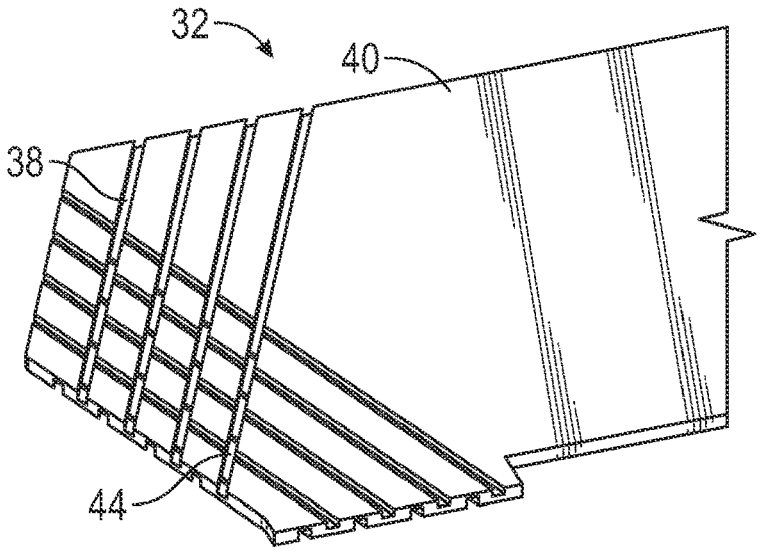
FIG. 3 is a perspective view of a first side of an end region of a fin segment of the heat exchanger according to the first embodiment of FIG. 2.
Figure 4:
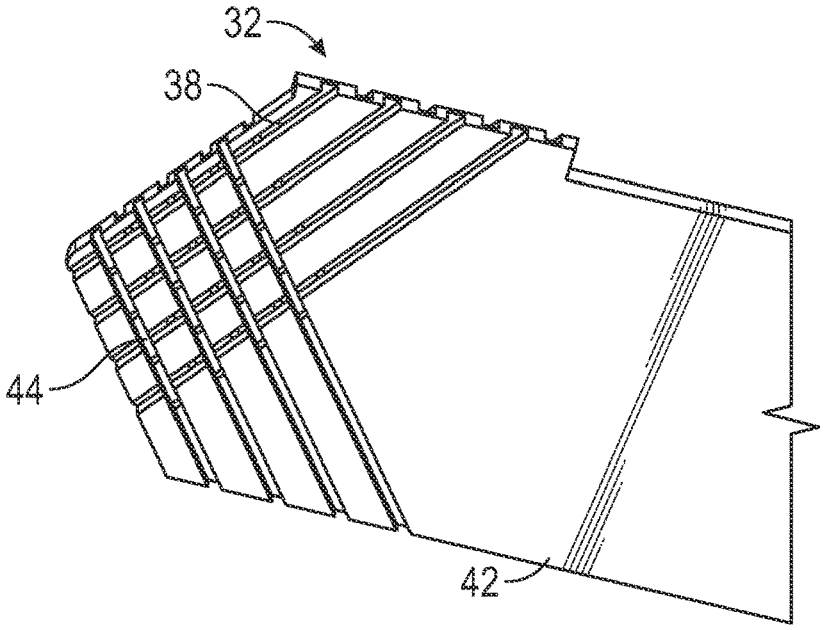
FIG. 4 is a perspective view of a second side of the end region of the fin segment of the heat exchanger according to the first embodiment of FIG. 2.

Referring now to FIGS. 2-4, a representative fluid layer 24 of the heat exchanger 10 is illustrated according to a first embodiment. The fluid layer 24 corresponds to a fluid layer that is configured to receive the first fluid 14 via the fluid inlet port 16 described above. The fluid layer 24 includes a first parting sheet 26 and a second parting sheet (not illustrated) and a frame 28 disposed within the first parting sheet 26 and the second parting sheet in a manner that sandwiches the frame 28 therebetween. Also disposed between the first parting sheet 26 and the second parting sheet is a fin segment 32 configured to conduct heat from or to the first fluid 14 being routed in the fluid layer 24. The fin segment 32 is sized to extend fully between the inlet end region 18 and the outlet end region 19 and to fit within an inner surface 21 of the frame 28. In the illustrated embodiment, the fin segment 32 is a single, uniform structure, such that multiple fin segments are not necessary. The frame 28 includes a first frame opening 34 and a second frame opening 36 that correspond to the fluid inlet port 16 and the fluid outlet port 22, respectively. Inclusion of the fin throughout the fluid layer, including at the inlet and outlet regions 18, 19, is beneficial for structural and fabrication purposes.

As described above, the frame openings 34, 36 are oriented in a position that receives the first fluid 14 in a direction that is substantially perpendicular to the predominant flow direction 20 of the first fluid 14 within the fluid layer 24. To facilitate rapid and efficient turning of the first fluid 14 proximate the fluid inlet port 16 at the inlet end region 18, the fin segment 32 according to the first embodiment of the heat exchanger 10 includes structural details that encourage rapid turning of the flow. In particular, referring to FIGS. 3 and 4, the fin segment 32 includes a plurality of grooves 38 defined by the fin segment 32 proximate the inlet end region 18. The plurality of grooves 38 are formed within at least one of a first surface 40 and a second surface 42 of the fin segment 32. In other words, the plurality of grooves 38 may be formed in either or both of the first surface 40 and the second surface 42, such that one or both surfaces include the grooves. A plurality of apertures 44 is also included in the fin segment 32. In one embodiment, the locations of the plurality of apertures 44 corresponds to overlapping regions of the plurality of grooves 38 that are located on the first surface 40 and the second surface 42 of the fin segment 32. Due to the nature of the grooves 38 going beyond a half-way point of the fin thickness, the apertures 44 at an intersection of the top and bottom surface grooves 38. As shown, turning of the flow at the outlet end region 19 of the fluid layer 24 is facilitated by a similar groove arrangement.

Figure 5:
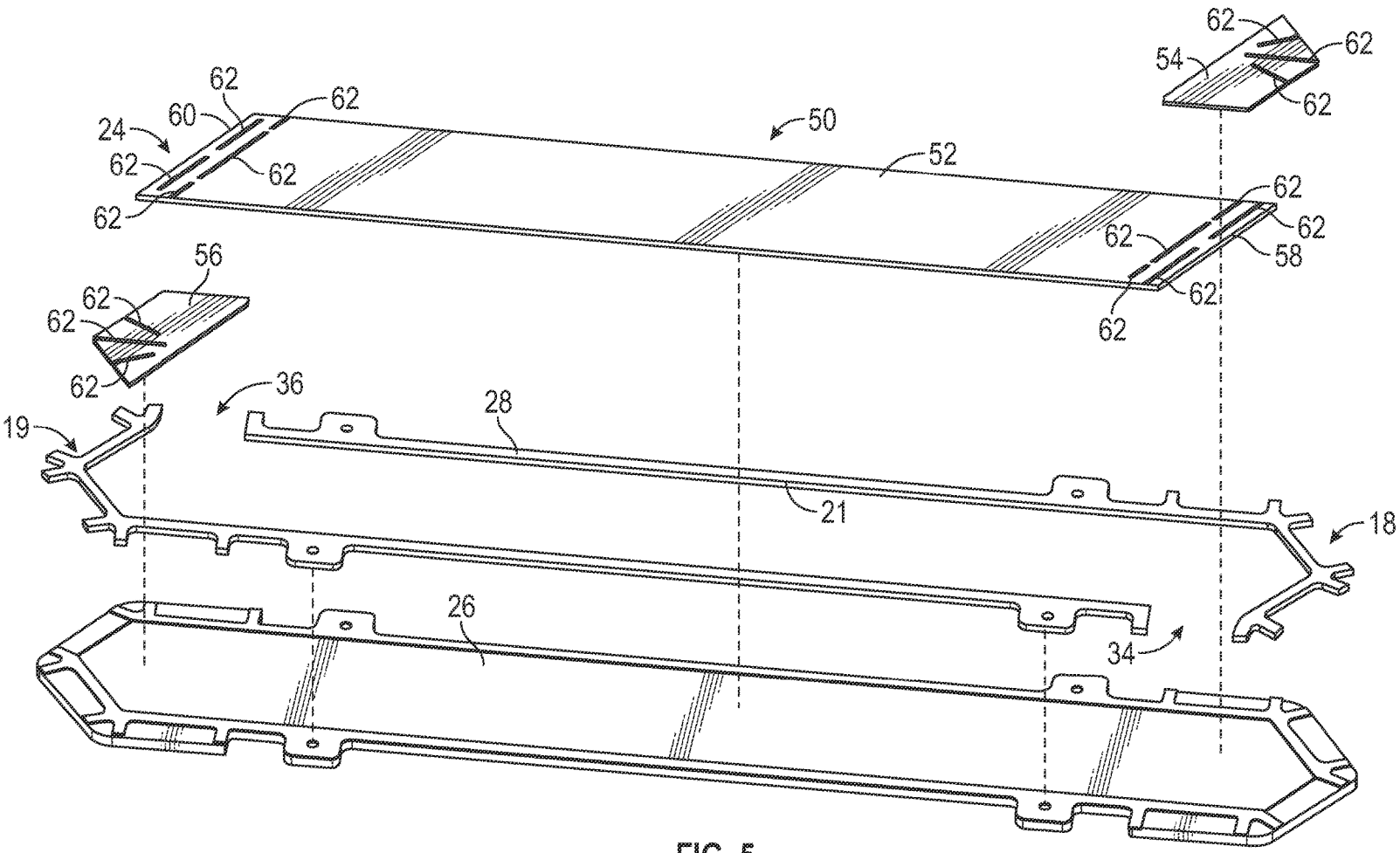
FIG. 5 is an exploded view of a layer of the heat exchanger according to a second embodiment.
Figure 6:
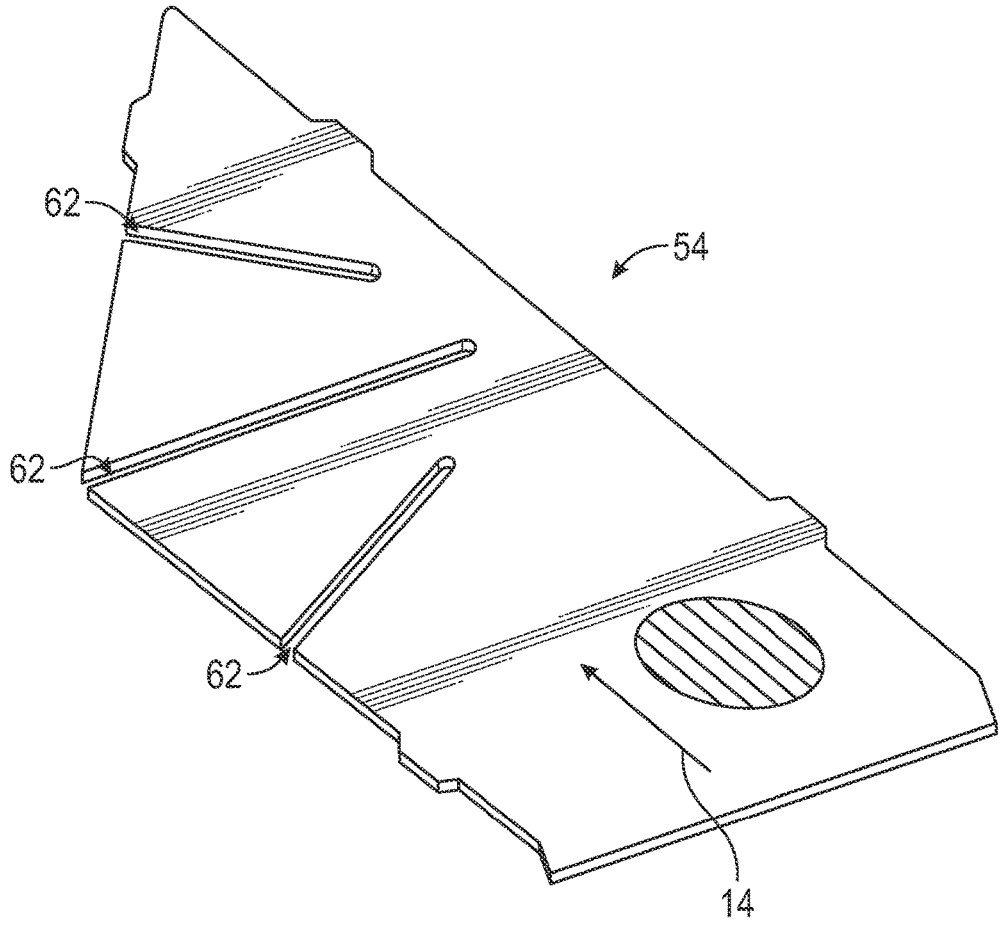
FIG. 6 is a perspective view of an end region of a fin segment of the heat exchanger according to the second embodiment of FIG. 5.

Referring now to FIGS. 5 and 6, the representative fluid layer 24 of the heat exchanger 10 is illustrated according to a second embodiment. As with the first embodiment described above, the fluid layer 24 corresponds to a fluid layer that is configured to receive the first fluid 14 via the fluid inlet port 16. The fluid layer 24 includes the first parting sheet 26 and a second parting sheet (not illustrated) and the frame 28 disposed within the first parting sheet 26 and the second parting sheet in a manner that sandwiches the frame 28 therebetween. Also disposed between the first parting sheet 26 and the second parting sheet is a fin arrangement 50 configured to conduct heat from or to the first fluid 14 being routed in the fluid layer 24.

The fin arrangement 50 is sized to extend fully between the inlet end region 18 and an outlet end region 19 and to fit within an inner surface 21 of the frame 28. In the illustrated embodiment, the fin arrangement 50 includes a first fin segment 52, a second fin segment 54 and a third fin segment 56, such that additional fin segments are not necessary. The first fin segment 52 is a central fin segment disposed in a central region of the fluid layer 24 and extends from a first end 58 to a second end 60. The first fin segment 52 is generally rectangular, but other shapes are contemplated. The second fin segment 54 is an inlet end fin segment disposed at the inlet end region 18 of the fluid layer 24 and is configured to abut the first end 58 of the first fin segment 52. The third fin segment 56 is an outlet fin segment disposed at the outlet end region 19 of the fluid layer 24 and is configured to abut the second end 60 of the first fin segment 52. The second fin segment 54 and the third fin segment 56 are shaped in a non-rectangular geometry to correspond to the non-linear end region geometries 18, 19 of the fluid layer 24.

As described above, the frame openings 34, 36 are oriented in a position that receives the first fluid 14 in a direction that is substantially perpendicular to the predominant flow direction 20 of the first fluid 14 within the fluid layer 24. To facilitate rapid and efficient turning of the first fluid 14 proximate the fluid inlet port 16 at the inlet end region 18, the fin arrangement 50 according to the second embodiment of the heat exchanger 10 includes structural details that encourage rapid turning of the flow. In particular, the fin arrangement 50 includes a plurality of apertures 62 proximate the inlet end region 18. The plurality of apertures 62 may be formed in any geometry, such as the illustrated slots. The plurality of apertures 62 is defined by the second fin segment 54, the third fin segment 56, and optionally the first fin segment 52. Specifically, the apertures 62 may be formed in any combination of the fin segments. As illustrated in FIG. 5, apertures 62 are present in the second fin segment 54 and the third fin segment 56. Additionally, in the illustrated embodiment, the first fin segment 52 includes apertures 62 located proximate the first end 58 and the second end 60 thereof, however, as noted above, the apertures 62 may be omitted from the first fin segment 52. As shown, turning of the flow at the outlet end region 19 of the fluid layer 24 is facilitated by a similar aperture arrangement.

The embodiments described herein address turning of flow in heat exchangers that require inlet and/or outlet ports to be positioned in an orientation that introduces or expels the fluid in a direction substantially perpendicular to the predominant flow direction of the fluid. End regions of such heat exchangers are typically arranged in a "tented" manner that requires a number of angled fin segments located at or near the end regions. Advantageously, the embodiments described herein include fin arrangements that lower the number of fin segments required, thereby lowering part count and overall costs associated with labor and manufacturing.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A multi-layer heat exchanger comprising:

a fluid layer defined by a first sheet and a second sheet, the fluid layer configured to route a fluid in a predominant flow direction;

a fluid inlet port disposed an inlet end region of the fluid layer, wherein the fluid inlet port is oriented to introduce the fluid into the fluid layer in a direction perpendicular to the predominant flow direction, wherein the inlet end region of the fluid layer is V-shaped;

at least one fin segment disposed between the first sheet and the second sheet, wherein the at least one fin segment includes a first plurality of apertures at the inlet end region, wherein the at least one fin segment consists of a first fin segment, a second fin segment and a third fin segment, the first fin segment being a rectangular segment, the second and third fin segments each being non-rectangular fin segments, the second fin segment abutting a first end of the first fin segment, the third fin segment abutting a second end of the first fin segment;

wherein the first fin segment is a central fin segment disposed in a central region of the fluid layer, the second fin segment is an inlet end fin segment disposed at the inlet end region of the fluid layer, and the third fin segment is an outlet fin segment disposed at an outlet end region of the fluid layer, wherein the first plurality of apertures is defined by the inlet end fin segment, the first plurality of apertures being slots extending from an end of the inlet end fin segment to at least a midpoint of the inlet end fin segment in the longitudinal direction of the multi-layer heat exchanger, and the slots extending completely through the inlet end fin segment in a thickness direction of the inlet end fin segment;

a second plurality of apertures defined by the central fin segment; and a third plurality of apertures defined by the outlet fin segment.

2. The multi-layer heat exchanger of claim 1, further comprising an outlet fluid port disposed at the outlet end region of the fluid layer, wherein the fluid outlet is oriented to expel the fluid from the fluid layer in a direction perpendicular to the predominant flow direction, wherein the outlet end region of the fluid layer is V-shaped.

* * * * *